US011332988B2

(12) United States Patent
Hveding et al.

(10) Patent No.: US 11,332,988 B2
(45) **Date of Patent: *May 17, 2022**

(54) TRAVERSING ACROSS A WASH-OUT ZONE IN A WELLBORE

(71) Applicant: Saudi Arabian Oil Company, Dhahran (SA)

(72) Inventors: Frode Hveding, Dhahran (SA); Saeed M. AlMubarak, Safwa (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/927,673

(22) Filed: Jul. 13, 2020

(65) Prior Publication Data

US 2020/0340316 A1 Oct. 29, 2020

Related U.S. Application Data

(63) Continuation of application No. 15/998,830, filed on Aug. 16, 2018, now Pat. No. 10,711,548.
(Continued)

(51) Int. Cl.
*E21B 23/00* (2006.01)
*E21B 4/18* (2006.01)
*E21B 23/14* (2006.01)

(52) U.S. Cl.
CPC ..... *E21B 23/001* (2020.05); *E21B 4/18* (2013.01); *E21B 23/00* (2013.01); *E21B 23/14* (2013.01)

(58) Field of Classification Search
CPC . E21B 23/00; E21B 4/18; E21B 23/14; E21B 23/001
See application file for complete search history.

(56) References Cited

U.S. PATENT DOCUMENTS 3,302,715 A 2/1967 Smith et al.
4,676,310 A 6/1987 Scherbatskoy et al.
(Continued)

FOREIGN PATENT DOCUMENTS

CN 104455911 3/2015
GB 2454697 5/2009
(Continued)

OTHER PUBLICATIONS

EPO Communication in European Application No. 18845898.8 dated Jul. 28, 2020, 9 pages.
(Continued)

*Primary Examiner* — Brad Harcourt
(74) *Attorney, Agent, or Firm* — Fish & Richardson P.C.

(57) ABSTRACT

A wellbore tractor is capable of being positioned in a wellbore that includes a cased section, a first uncased section downhole of the cased section, and a second uncased section downhole of the first uncased section. The wellbore tractor is capable of self-propelling itself through the wellbore. An anchoring system is connected to the wellbore tractor. The anchoring system includes an appendage. When the wellbore tractor is in the cased section, the anchoring system is capable of extending the appendage from the cased section through the first uncased section into the second uncased section, anchoring the appendage in the second uncased section, and guiding the wellbore tractor from the cased section past the first uncased section and into the second uncased section.

8 Claims, 8 Drawing Sheets

Related U.S. Application Data

(60) Provisional application No. 62/547,612, filed on Aug. 18, 2017.

(56) References Cited

U.S. PATENT DOCUMENTS

| | | | | |
|---|---|---|---|---|
| 6,173,787 | B1 | 1/2001 | Wittrisch | |
| 6,179,058 | B1 | 1/2001 | Wittrisch | |
| 6,273,189 | B1 | 8/2001 | Gissler et al. | |
| 6,345,669 | B1 | 2/2002 | Buyers et al. | |
| 6,450,104 | B1 | 9/2002 | Grant et al. | |
| 6,868,913 | B2 | 3/2005 | Vidrine et al. | |
| 6,887,014 | B2 | 5/2005 | Holland | |
| 7,185,700 | B2 | 3/2007 | Collins et al. | |
| 9,097,086 | B2 | 8/2015 | AlDossary | |
| 10,711,548 | B2 * | 7/2020 | Hveding | E21B 4/18 |
| 2005/0034874 | A1 | 2/2005 | Geurrero et al. | |
| 2005/0211433 | A1 | 9/2005 | Wilson et al. | |
| 2009/0218105 | A1 | 9/2009 | Hill et al. | |
| 2012/0241172 | A1 | 9/2012 | Ludwig et al. | |
| 2012/0313790 | A1 | 12/2012 | Heijnen et al. | |
| 2013/0025885 | A1 | 1/2013 | Mineo et al. | |
| 2014/0054031 | A1 | 2/2014 | Heijnen et al. | |

FOREIGN PATENT DOCUMENTS

| | | |
|---|---|---|
| GB | 2434819 | 8/2009 |
| WO | WO 2012119837 | 9/2012 |

OTHER PUBLICATIONS

Gulf Cooperation Council Examination Report issued in GCC Application No. GC 2018-35877 dated Jan. 14, 2020, 5 pages.

International Search Report and Written Opinion issued in International Application No. PCT/US2018/00355 dated Nov. 30, 2018, 13 pages.

Gulf Cooperation Council Examination Report issued in GCC Application No. GC 2018-35877 dated May 7, 2020, 4 pages.

EPO Communication Pursuant to Article 94 (3) EPC issued in European Application No. 18845898.8 on Feb. 2, 2022, 8 pages.

* cited by examiner

TRAVERSING ACROSS A WASH-OUT ZONE IN A WELLBORE

CROSS-REFERENCE TO RELATED APPLICATIONS

This application is a Continuation of and claims priority to U.S. patent application Ser. No. 15/998,830, filed on Aug. 16, 2018, which in turn claims the benefit of priority to U.S. Provisional Application Ser. No. 62/547,612, filed on Aug. 18, 2017, the contents of which are hereby incorporated by reference.

TECHNICAL FIELD

This disclosure relates to wellbore drilling, completions, and work-overs.

BACKGROUND

A wellbore can consist of a mixture of casing, tubing, liner and/or open hole. In the open hole section, there can be wash-out zones due to, for instance, well stimulation or if a casing is landed short of the actual drilled hole.

SUMMARY

This disclosure describes technologies relating to traversing a wellbore.

An example implementation of the subject matter described within this disclosure is a wellbore tool system with the following features. A wellbore tractor is configured to be positioned in a wellbore that has a cased section, a first uncased section downhole of the cased section, and a second uncased section downhole of the first uncased section. The wellbore tractor is configured to self-propel through the wellbore. An anchoring system is connected to the wellbore tractor. When the wellbore tractor is in the cased section, the anchoring system is configured to extend from a distal end of the wellbore tractor and the cased section through the first uncased section into the second uncased section. The anchoring system is configured to secure an anchor in the second uncased section. The anchoring system is configured to guide the wellbore tractor from the cased section past the first uncased section and into the second uncased section.

Aspects of the example implementation, which can be combined with the example implementation alone or in combination, include the following. The first uncased section has a larger diameter than the cased section. The first uncased section is downhole of the cased section. The second uncased section has a smaller diameter than the first uncased section and the cased section. The second uncased section is positioned downhole of the first uncased section.

Aspects of the example implementation, which can be combined with the example implementation alone or in combination, include the following. The anchoring system includes an extension tool coupled to the anchor. The extension tool is configured to extend the anchor when activated. The anchor is coupled to the extension tool. The anchor is configured to attach to a wall in the second uncased section.

Aspects of the example implementation, which can be combined with the example implementation alone or in combination, include the following. The anchor is coupled to the extension tool by a rod configured to cross a wash-out zone in a wellbore.

Aspects of the example implementation, which can be combined with the example implementation alone or in combination, include the following. The extension tool includes wheels housed within the wellbore tool. The wheels are configured to extend and retract the rod out of and into the wellbore tractor, respectively.

Aspects of the example implementation, which can be combined with the example implementation alone or in combination, include the following. The anchor is coupled to the extension tool by a flexible tether. The flexible tether is configured to guide the wellbore tractor from the cased section past the first uncased section and into the second uncased section.

Aspects of the example implementation, which can be combined with the example implementation alone or in combination, include the following. The extension tool includes a pneumatic launcher configured to launch the anchor from a downhole end of the wellbore tool.

Aspects of the example implementation, which can be combined with the example implementation alone or in combination, include the following. The extension tool includes a spring launcher configured to launch the anchor from a downhole end of the wellbore tool.

Aspects of the example implementation, which can be combined with the example implementation alone or in combination, include the following. A retraction tool is configured to move a string across a wash-out zone by retracting the anchor. The retraction tool has sufficient strength to pull a weight of a string across a wash-out zone.

Aspects of the example implementation, which can be combined with the example implementation alone or in combination, include the following. A shearing tool is configured to detach the anchor from the wellbore tool.

An example implementation of the subject matter described within this disclosure is a method with the following features. A wellbore tractor is run into a deviated or horizontal wellbore with a cased section, a first uncased section downhole of the cased section, and a second uncased section downhole of the first uncased section. The wellbore tractor is configured to self-propel through the wellbore. An anchor is extended from the wellbore tractor across the first uncased section. The wellbore tractor is guided and propelled from the first uncased section to the second uncased section by retracting the anchor.

Aspects of the example implementation, which can be combined with the example implementation alone or in combination, include the following. Extending the anchor includes pneumatically launching the anchor.

Aspects of the example implementation, which can be combined with the example implementation alone or in combination, include the following. Extending the anchor includes mechanically extending a rod so that a portion of the rod is exposed. An unexposed portion of the rod provides structural support to an exposed portion of the rod.

Aspects of the example implementation, which can be combined with the example implementation alone or in combination, include the following. The wellbore includes a cased section extending to a cased section depth and a first uncased section having a larger diameter than the cased section. The first uncased section is positioned at a downhole end of the cased section. A second uncased section has a smaller diameter than the first uncased section and the cased section. The second uncased section is positioned at the downhole end of the first uncased section. The method further includes securing the anchor to a wall of the second uncased section.

Aspects of the example implementation, which can be combined with the example implementation alone or in combination, include the following. The anchor is released from a wall of the second uncased section. The anchor is retracted toward the wellbore tractor.

Aspects of the example implementation, which can be combined with the example implementation alone or in combination, include the following. The anchor is decoupled from the wellbore tractor.

An example implementation of the subject matter described within this disclosure is a system with the following features. A wellbore tool is positioned in a wellbore with a cased section extending from the wellbore surface to a cased section depth. A first uncased section has a larger diameter than the cased section. The first uncased section is positioned at a downhole end of the cased section. A second uncased section has a smaller diameter than the first uncased section and the cased section. The second uncased section is positioned at the downhole end of the first uncased section. An anchoring system is connected to the wellbore tool. An anchor is positioned at a downhole end of the wellbore tool. The anchor is configured to be retracted toward the wellbore tool while in a deactivated state and extended from the downhole end of the wellbore tool when activated. The anchor is configured to be extended from the cased section to the second uncased section when in an activated state. The anchor is configured to help the wellbore tool from the cased section to the second uncased section across the first uncased section. The anchor is configured to attach to a wall in the second uncased section. An extension tool is coupled to the anchor. The extension tool is configured to extend the anchor when the anchor is activated.

Aspects of the example implementation, which can be combined with the example implementation alone or in combination, include the following. The extension tool includes a pneumatic launcher housed within the wellbore tool.

Aspects of the example implementation, which can be combined with the example implementation alone or in combination, include the following. The extension tool includes wheels housed within the wellbore tool. The wheels are configured to roll the anchor from a retracted position to an extended position.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

In horizontal or deviated wellbores, a wash-out zone, or "rat-hole", can be difficult to traverse. That is, wellbore tools or sections of casing can become lodged in the wash-out zone before reaching their intended destination. Wellbore tractors are not always sufficient to traverse such a wash-out zone.

This disclosure discusses a wellbore tool, such as a wellbore tractor, that can include an extendable anchor at a downhole end of the wellbore tool. The appendage can be extended across the wash-out zone or another larger diameter section of a horizontal or deviated wellbore. The extendable anchor can anchor into the wall of the smaller diameter portion of the wellbore that is downhole of the wash-out zone, and the wellbore tool can cross the larger diameter section by retracting the anchor, which drags the wellbore tool across the wash-out zone. In some implementations, the anchor can be coupled to the wellbore tool by a rod that is sufficiently stiff to support the weight of the tractor across the larger diameter section. In some implementations, a cable or tether system can be similarly used. The anchor can be decoupled by shearing either the cable or the rod if needed.

Figure 1A:
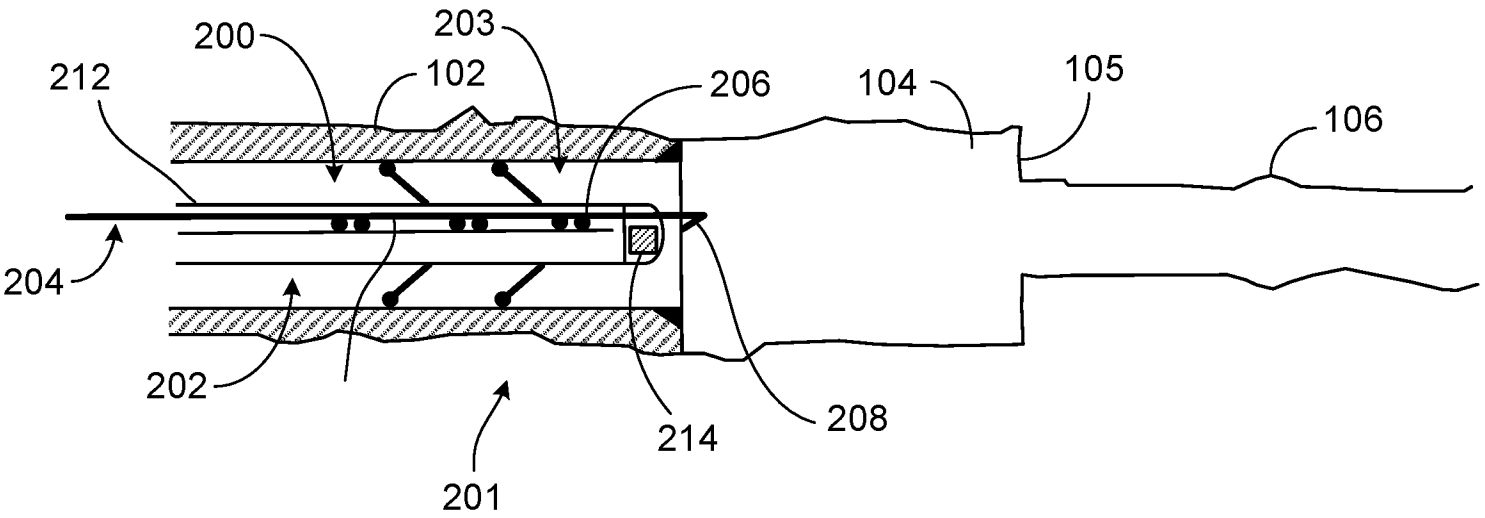
FIGS. 1A-1D are schematic diagrams of a side cut-away view of a wellbore tool within a horizontal wellbore.

FIG. 1A shows a wellbore tool system 200 positioned in a wellbore 201. The wellbore 201 includes a cased section 102 extending to a cased section depth. Downhole of the cased section 102 is a first uncased section 104 that has a larger diameter than the cased section 102. The first uncased section 104 can be a wash-out zone. The first uncased section 104 is sometimes the remnants of the wellbore formed for the cased section, that is, the first uncased section can be the spare length that was drilled before the casing was installed. As a result, the first uncased section can have sufficient diameter to receive casing and cement for a cased section 102. Downhole of the first uncased section 104 is a second uncased section 106 that has a smaller diameter than the first uncased section 104 and the cased section 102.

In the illustrated implementation, the wellbore tool system 200 includes a wellbore tractor 202. The wellbore tractor 202 can be an electric tractor, a hydraulic tractor, or any other wellbore tractor. While the described implementation utilizes the wellbore tractor 202, aspects of this disclosure can be used in other wellbore tools. The wellbore tractor 202 can self-propel itself and a string 212 through the wellbore. In the case of an electric wellbore tractor, multiple wheels can be driven by an electric motor located within the wellbore tractor 202 to propel the wellbore tractor 202 and the string 212 through the wellbore. In the case of a hydraulic tractor, a downhole section of the wellbore tractor 202 can attach itself to the walls of the wellbore and hydraulically pull the string 212 through the wellbore. Once the string has been pulled a distance built into the design of the tractor, the forward part of the tractor detaches itself from the wellbore wall while an uphole section of the tractor attaches itself to the wall of the wellbore. After the uphole end of the wellbore tractor 202 has attached itself to the wellbore wall, the downhole end of the wellbore tractor is hydraulically propelled in a downhole direction. The process is then repeated as the wellbore tractor moves in a downhole direction with movement similar to an inchworm. The tractor itself can be controlled via control lines that run through the wellbore from the wellbore tractor 202 to a topside facility.

Figure 1B:
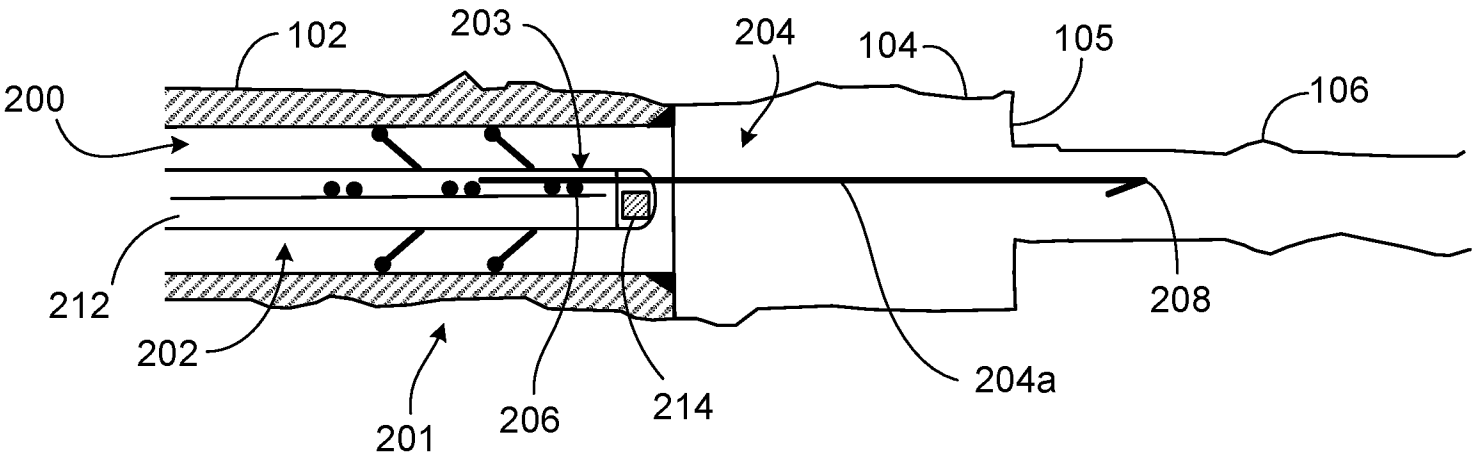

An anchoring system 203 is connected to the wellbore tractor 202 and includes an extendable link 204. The extendable link 204 can be retracted within the wellbore tractor 202 while the extendable link 204 is in a deactivated state and extended out of the downhole end of the wellbore tractor 202 when the extendable link 204 is in an activated state. For example, the extendable link 204 can be extended from the cased section 102 through the first uncased section 104 into the second uncased section 106. As shown in FIG. 1B, the extendable link 204 extends a sufficient distance into the second uncased section 106 to allow the wellbore tractor 202 to sufficiently traverse the first uncased section 104 without impacting the interface 105 between the first uncased section 104 and the second uncased section 106. As described later, the extendable link 204 is capable of guiding the wellbore tractor 202 from the cased section 102 to the second uncased section 106 across the first uncased section 104. That is, the extendable link 204 is capable of supporting the weight of the wellbore tractor 202 and the string. The wellbore tractor 202 also includes an extension tool 206 housed within the wellbore tractor 202 and connected to the extendable link 204. The extension tool 206 can extend the extendable link 204 when the extendable link 204 is activated.

In some implementations, the wellbore tractor 202 can include a shearing tool 214 in the event of such a failure. Other events that warrant shearing are described later in this disclosure. A standard weak point system can be included in the shear system. For example, a specific number of shear screws can be used to set a weak point in the system that will experience a shear failure if sufficient force is applied. A stronger weak point includes more shear screws, while a weaker weak point includes fewer shear screws.

In some implementations, the extension tool 206 can include wheels housed within the wellbore tractor 202. The wheels can extend the extendable link 204 out of the wellbore tractor 202 to the extended position, retract the appendage into the wellbore tractor to the retracted position, or both. In such an implementation, the extendable link 204 can include a stiff rod 204*a*. The stiff rod 204*a* has sufficient stiffness to prevent sagging when the extendable link 204 is fully extended and while the wellbore tractor 202 traverses the first uncased section 104. The stiff rod 204*a* can have sufficient strength to support the wellbore tractor 202 and string 212 across the first uncased section 104. The stiff rod 204*a* can include carbon fiber, steel, or any other material to provide sufficient strength within the downhole environment. The stiff rod 204*a* can be of sufficient length to cross the wash-out zone and anchor itself in the second uncased section 106. That is, the stiff rod 204*a* can be longer than the length of the wash-out zone. In some implementations, a portion of the stiff rod 204*a* can remain within the wellbore tractor 202 to help maintain structural strength of the wellbore tool system 200. In some implementations, the stiff rod 204*a* can be extended between the center and the edge of the wellbore tractor. In some instances, the stiff rod 204*a* can be extended from a point above the centerline of the wellbore tractor.

Figure 1C:
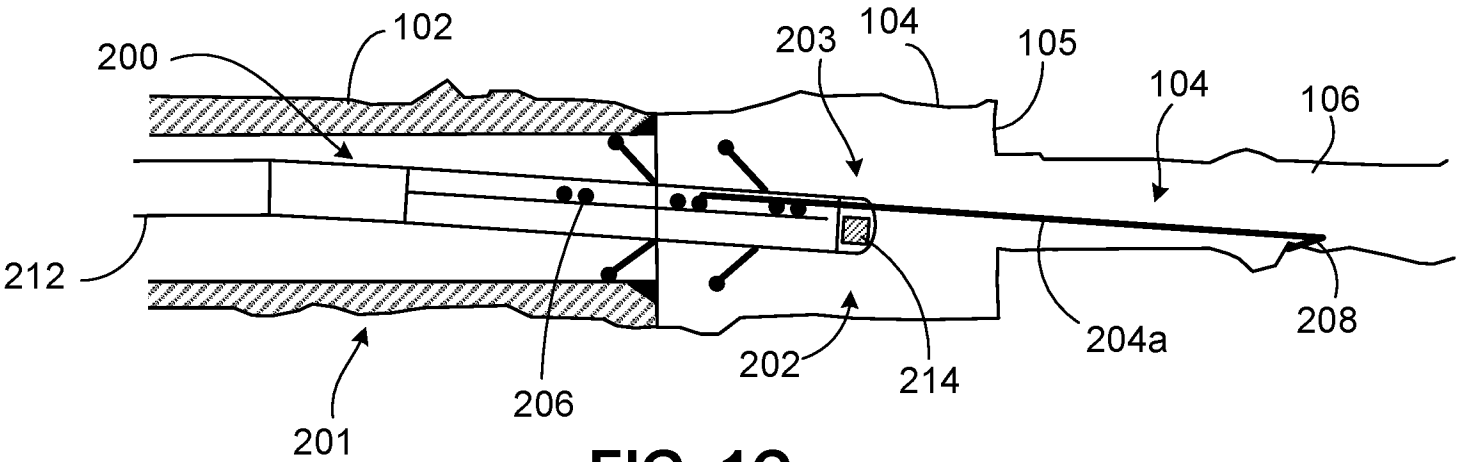
Figure 1D:
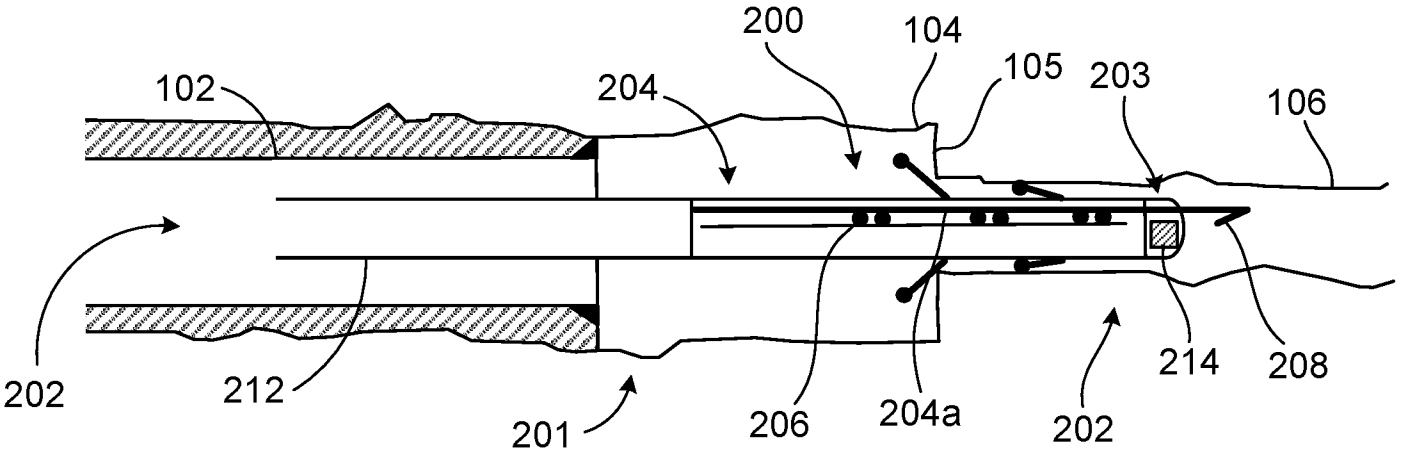

An anchor 208 is attached to the downhole end of the extendable link 204. The anchor 208 can include a hook, a barb, a pneumatic punch, or any other device capable of attaching to a rock-like surface as shown in FIG. 1C. The anchor 208 can attach the downhole end of the extendable link 204 to a wall in the second uncased section 106 of the wellbore. The anchor 208 can include a grappling hook, barb, or other appropriate anchor device. Once the anchor 208 is secured to the wall in the second uncased section 106 of the wellbore, the extendable link 204 is retracted. The retraction pulls the sting 212 across the wash-out zone (first uncased section 104) as shown in FIG. 1D. While the illustrated implementation is shown in a horizontal wellbore, similar implementations can be used in any wellbore that deviates from vertical, or a deviated wellbore that is 60° from vertical.

Figure 2A:
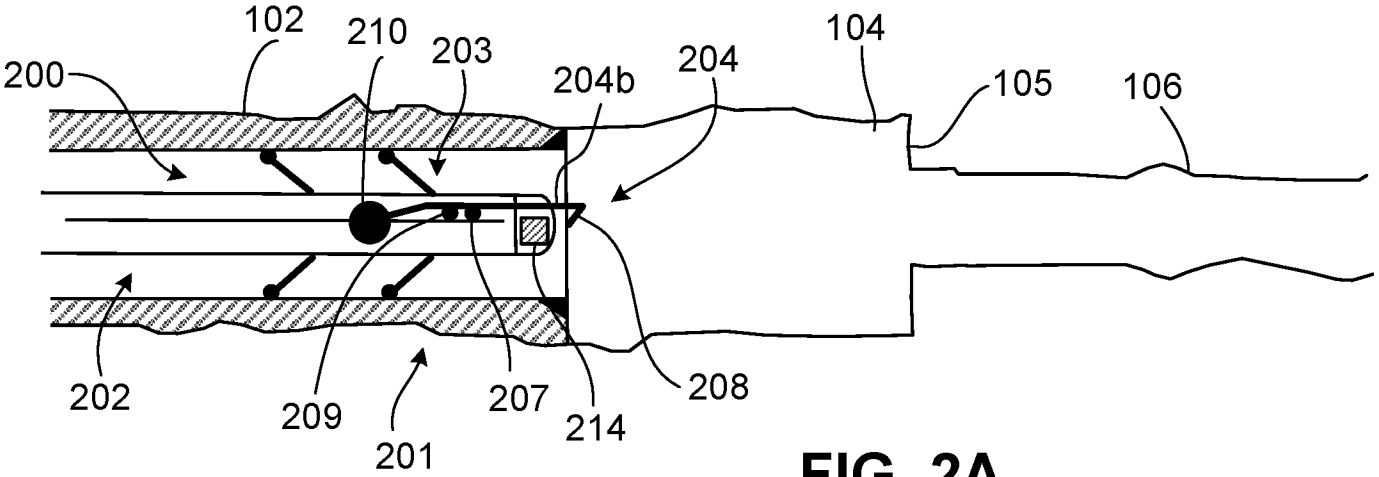
FIGS. 2A-2D are schematic diagrams of a side cut-away view of a wellbore tool within a horizontal wellbore.
Figure 2B:
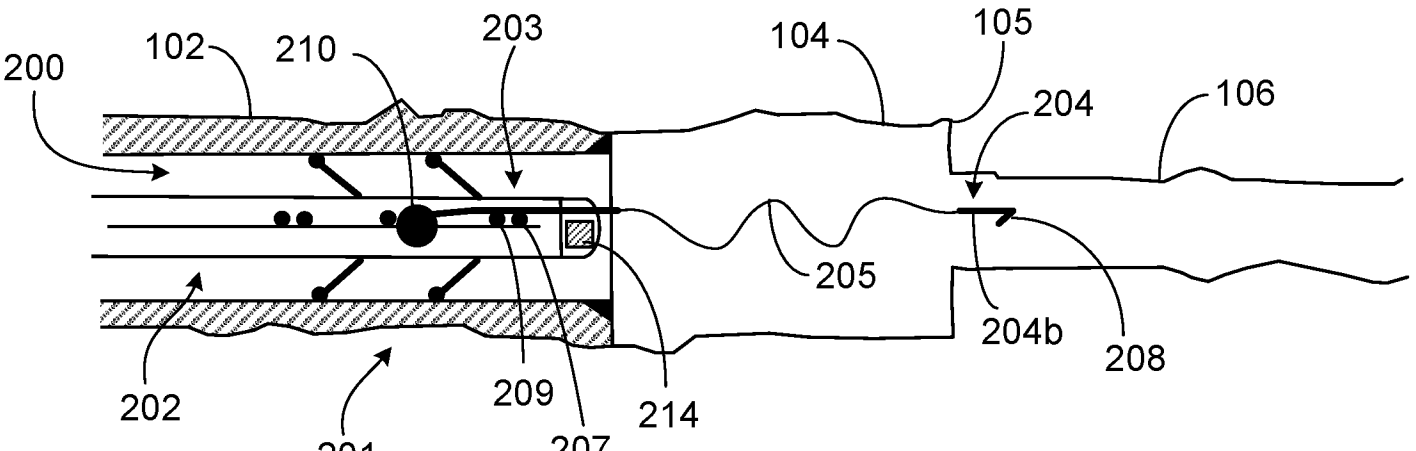
Figure 2C:
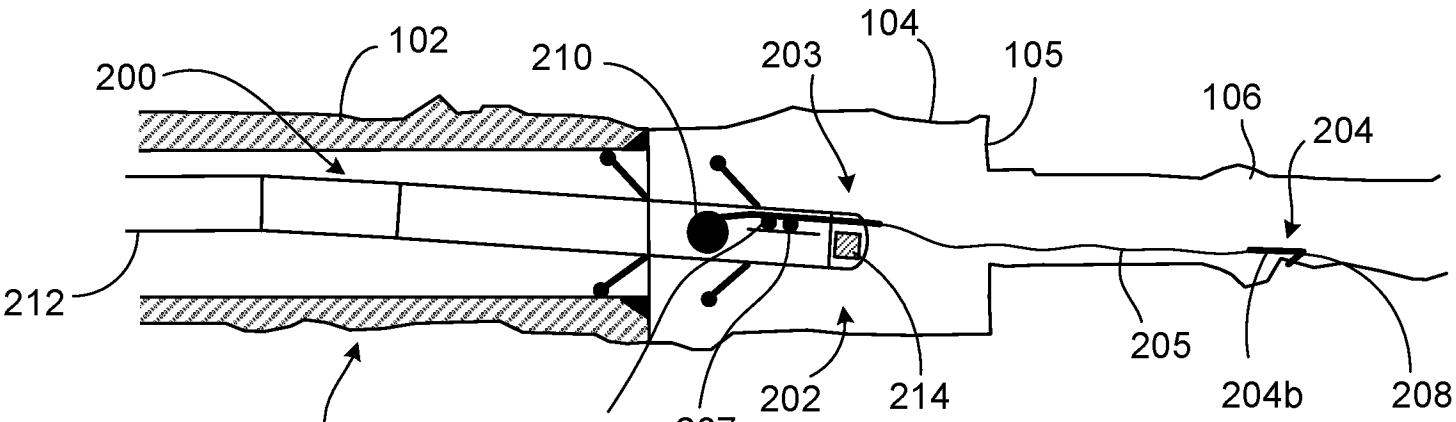

FIG. 2A shows an implementation of the subject matter where the extendable link 204 includes a harpoon-like rod 204*b* that is ejected from the wellbore tractor 202 when activated, as shown in FIG. 2B. When a harpoon-like rod 204*b* is used, a flexible tether 205 connects the extendable link 204 (harpoon-like rod 204*b*) to the wellbore tractor 202 when the extendable link 204 is in the extended state. The flexible tether 205 is stored within the wellbore tractor 202 prior to use on a spool 210. While a lateral spool 210 is illustrated, any spool, reel, winch, or other cable storage system can be used. The extension tool 206 can include a pneumatic launcher 207 housed within the wellbore tool. The launcher 207 can be capable of launching the extendable link 204 from the downhole end of the wellbore tractor 202 and towards the second uncased section 106. In such an implementation, the extendable link 204, in an extended state, extends completely from the wellbore tractor 202. That is, complete extension includes an entire length of a rod being exposed to the wellbore. The flexible tether 205 can guide the wellbore tractor 202 from the cased section 102 past the first uncased section 104 and into the second uncased section 106, as shown in FIG. 2C.

Figure 2D:
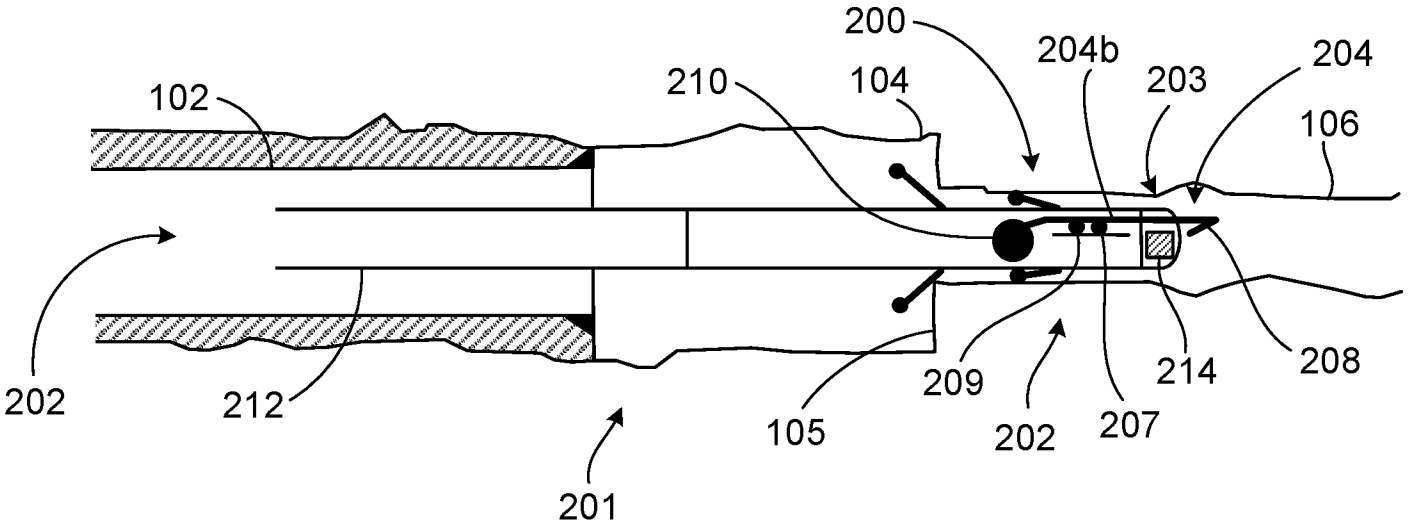

Once the wellbore tractor 202 has traversed the first uncased section 104, as shown in FIG. 2D, the flexible tether 205 can be retracted within the tool or sheared off to allow the wellbore tractor 202 to progress through the wellbore. In such an implementation, wellbore tractor 202 can include a retraction mechanism 209 that is separate from the extension tool 206, such as a motorized wheel or conveyer. In some implementations, the spool 210 rotates to retract the tether 205. The retraction mechanism 209 is capable of moving the wellbore tool and the string 212 across a wash-out zone 104 by retracting the flexible tether 205. The retraction mechanism 209 and harpoon-like rod 204*b* have sufficient strength to pull a weight of the string 212 and the wellbore tractor 202 across the wash-out zone 104. The wellbore tractor 202 can also include a shearing tool 214 that is capable of shearing the flexible tether 205. A flexible tether 205 can be sheared for a number of reasons, such as the harpoon-like rod 204*b* becoming stuck or broken. In some implementations, after the wellbore tractor 202 has successfully traversed the wash-out zone 104, the flexible tether 205 can be sheared to allow further travel of the wellbore tractor 202. The shear mechanism can include a shear pin. A shear pin can be designed to shear at certain tension. For example, the pin can shear at specific pull or push based on the number of shear pins included. While a shear pin system is described within this disclosure, any shearing mechanism can be used. In some implementations, the flexible tether 205 (or the stiff rod 204*a*) can be sheared by an over-pull on the string from the surface.

Figure 3A:
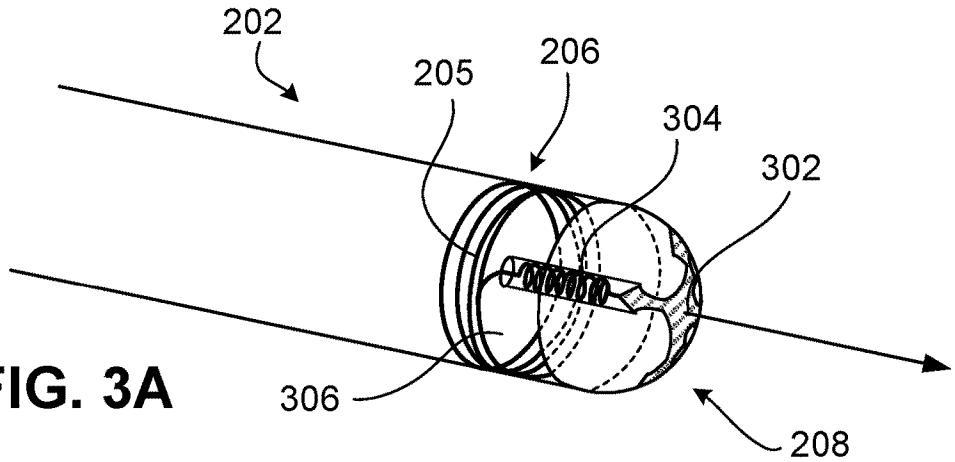
FIGS. 3A-3B are schematic diagrams of a perspective cut-away view of a wellbore tool within a horizontal wellbore.
Figure 3B:
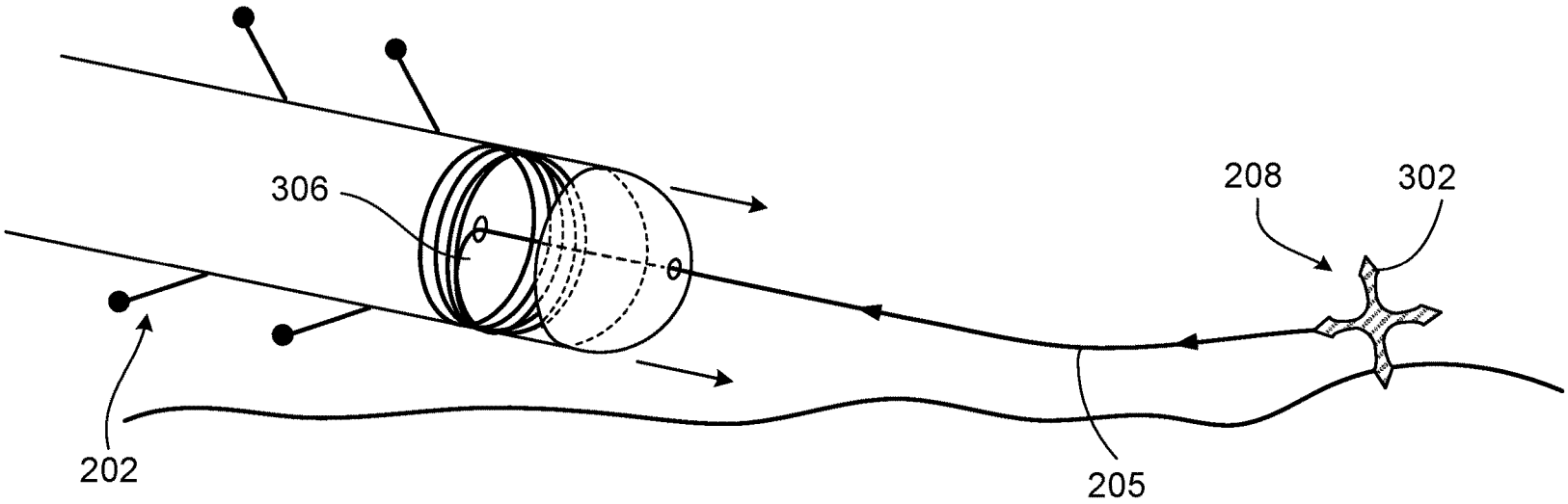

FIG. 3A shows an implementation of the subject matter where the anchor 208 is a grappling hook 302 that is ejected from the wellbore tractor 202 when activated, as shown in FIG. 3B. When the grappling hook 302 is used, a flexible tether 205 connects the grappling hook 302 to the wellbore tractor 202 when the extendable link 204 is in the extended state. The flexible tether 205 can be stored within the wellbore tractor 202 prior to use in an axial reel 306. While illustrated as an axial reel, the tether 205 can be stored on a lateral winch, spool, or any other tether storage device. The extension tool 206 can include a spring launcher 304 housed within the wellbore tool. While illustrated with the spring launcher 304, other launchers, such as the pneumatic launcher 207 (FIGS. 2A-2D), can be used without departing from this disclosure. The spring launcher 304 is capable of launching the anchor 208 from the downhole end of the wellbore tractor 202 and towards the second uncased section 106. In such an implementation, the grappling hook 302, in an extended state, extends completely from the wellbore tractor 202. The flexible tether 205 can guide the wellbore tractor 202 from the cased section 102 past the first uncased section 104 and into the second uncased section 106, as shown in FIG. 3B.

Once the wellbore tractor 202 has traversed the first uncased section 104, the flexible tether 205 can be retracted within the tool or sheared off to allow the wellbore tractor 202 to progress through the wellbore. In such an implementation, wellbore tractor 202 can include a retraction mechanism 209 that is separate from the extension tool 206, such as the axial reel 306. The axial reel 306 is capable of moving the wellbore tool and the string 212 across a wash-out zone 104 by retracting the flexible tether 205. The retraction mechanism 209, the grappling hook 302, and the flexible tether 205 have sufficient strength to pull a weight of the string 212 and the wellbore tractor 202 across the wash-out zone 104. The wellbore tractor 202 can also include a shearing tool 214 that is capable of shearing the flexible tether 205. The flexible tether 205 can be sheared for a number of reasons, such as the grappling hook 302 becoming stuck or broken. In some implementations, after the wellbore tractor 202 has successfully traversed the wash-out zone 104, the flexible tether 205 can be sheared to allow further travel of the wellbore tractor 202. The shear mechanism can include a shear pin. A shear pin can be designed to shear at certain tension. For example, the pin can shear at specific pull or push force based on the number of shear pins included. While a shear pin system is described within this disclosure, any shearing mechanism can be used. In some implementations, the flexible tether 205 (or the stiff rod 204*a* in FIGS. 1A-2D) can be sheared by an over-pull on the string from the surface.

Figure 4:
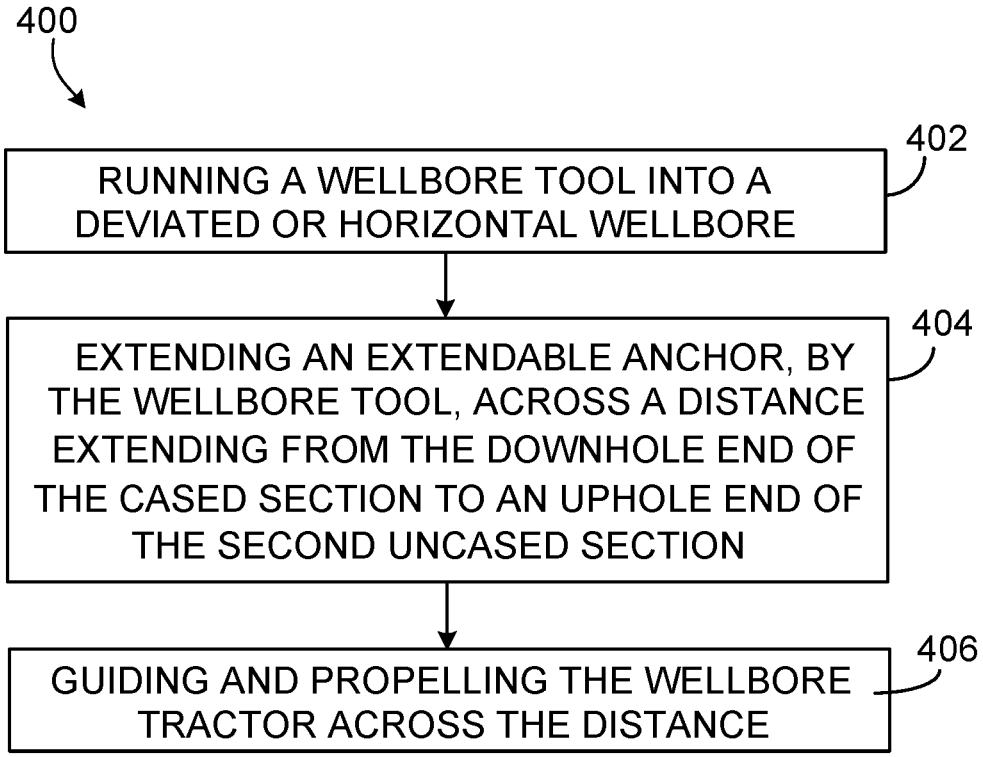
FIG. 4 is a flowchart showing a method of traversing a wash-out zone within a deviated or horizontal wellbore.

FIG. 4 shows a flowchart of an example method 400 that can be used to traverse a wash-out zone in a wellbore 201. At 402, a wellbore tractor is run into a deviated or horizontal wellbore that includes a cased section 102, a first uncased section 104 downhole of the cased section 102, and a second uncased section 106 downhole of the first uncased section 104. At 404, an anchor is extended from the wellbore tractor 202 across the first uncased section 104. After the anchor is extended, the anchor is anchored to a wall of the second uncased section 106. At 406 the wellbore tractor 202 is guided and propelled from the first uncased section 104 to the second uncased section 106 by the anchor.

In some implementations, the anchor can be released from the wall of the second uncased section 106, and the anchor can be retracted into the wellbore tractor 202. In some implementations, the anchor can be released from the wellbore tractor 202.

In some implementations, extending the anchor can include pneumatically launching the anchor. In some implementations, extending the extendable anchor includes mechanically extending a stiff rod so that only a portion of the stiff rod is exposed. An unexposed portion of the stiff rod can provide structural support to an exposed portion of the stiff rod.

While operations are depicted in the drawings in a particular order, this should not be understood as requiring that such operations be performed in the particular order shown or in sequential order, or that all illustrated operations be performed, to achieve desirable results. Moreover, the separation of various system components in the implementations previously described should not be understood as requiring such separation in all implementations, and it should be understood that the described program components and systems can generally be integrated together.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A system comprising:

a wellbore tool positioned in a wellbore comprising:

a cased section extending from wellbore surface to a cased section depth;

a first uncased section having a larger diameter than the cased section, the first uncased section being positioned at a downhole end of the cased section; and a second uncased section having a smaller diameter than the first uncased section and the cased section, the second uncased section positioned at the downhole end of the first uncased section; and an anchoring system connected to the wellbore tool comprising:

an anchor configured to be retracted toward the wellbore tool when deactivated and extended from the wellbore tool when activated, the anchor configured to be extended from the cased section to the second uncased section when activated, the anchor configured to help the wellbore tool from the cased section to the second uncased section across the first uncased section; and an extension tool coupled to the anchor, the extension tool configured to extend the anchor when the anchor is activated.

2. The system of claim 1, wherein the extension tool comprises a pneumatic launcher housed within the wellbore tool.

3. The system of claim 1, wherein the extension tool comprises a plurality of wheels housed within the wellbore tool, the wheels configured to roll the anchor from a retracted position to an extended position.

4. The system of claim 1, wherein the anchor is configured to attach to a wall in the second uncased section.

5. A method comprising:

running a wellbore tractor into a deviated or horizontal wellbore comprising a cased section, a first uncased section downhole of the cased section, and a second uncased section downhole of the first uncased section, the wellbore tractor configured to self-propel through the wellbore;

extending an anchor from the wellbore tractor across the first uncased section, wherein extending the anchor comprises pneumatically launching the anchor; and guiding and propelling the wellbore tractor from the first uncased section to the second uncased section by retracting the anchor.

6. The method of claim 5, wherein the wellbore comprises a cased section extending to a cased section depth, a first uncased section having a larger diameter than the cased section, the first uncased section being positioned at a downhole end of the cased section, and a second uncased section having a smaller diameter than the first uncased section and the cased section, the second uncased section positioned at the downhole end of the first uncased section, the method further composing:

securing the anchor to a wall of the second uncased section.

7. The method of claim 6, further comprising:

releasing the anchor from a wall of the second uncased section; and retracting the anchor toward the wellbore tractor.

8. The method of claim 6, further comprising decoupling the anchor from the wellbore tractor.

* * * * *